United States Patent [19]

Leber et al.

[11] 4,130,281

[45] Dec. 19, 1978

[54] HORSESHOE PITCHING GAME APPARATUS

[76] Inventors: Ralph E. Leber, R.R. 2, Box 248, Plymouth, Ind. 46563; Robert O. Baughman, 24633 Stanton Rd., North Liberty, Ind. 46554

[21] Appl. No.: 820,090

[22] Filed: Jul. 29, 1977

[51] Int. Cl.[2] ..... A63B 67/06

[52] U.S. Cl. ..... 273/100; 273/103

[58] Field of Search ..... 273/100, 101, 95 R, 273/103

[56] References Cited

U.S. PATENT DOCUMENTS

| | | | |
|---|---|---|---|
| 1,097,035 | 5/1914 | Lee | 273/100 UX |
| 1,543,767 | 6/1925 | Heggen | 273/100 X |
| 3,216,726 | 11/1965 | Andersen et al. | 273/100 |
| 3,326,556 | 6/1967 | Andersen | 273/100 X |

*Primary Examiner*—William H. Grieb

*Attorney, Agent, or Firm*—Marmaduke A. Hobbs

[57] ABSTRACT

A horseshoe pitching game apparatus having a court with a player station at one end, a horseshoe receiver assembly with a pit and a stake at the other end, and a lane between the station and pit assembly. A device is provided for traveling over the pit to pick up the pitched shoes and place them on the conveyor to be returned to the player station, and also smooths the material in the pit for the next pitch. A TV camera in conjunction with a computer may be used to determine whether the pitch is valid, and thereafter report the score on a screen or other suitable readout screen or sheet. Electrical magnets are preferably used to lift the shoes from the pit and to drop them on the conveyor for returning them to the station, and a backboard and sides are preferably responsive to contact by the shoes to indicate whether the shoes are legal or illegal pitches.

13 Claims, 8 Drawing Figures

HORSESHOE PITCHING GAME APPARATUS

The game of horseshoe pitching has been a popular sport for a great many years, but during all its long history it has not become a game which can be conveniently promoted commercially, comparable to bowling, or operated in such a manner that the court can be effectively operated and maintained by a supervisor to provide consistent and optimum playing conditions. Further, notwithstanding the popularity of the game at large gatherings, such as outdoor picnics and fairs, the game has not lent itself to participation by occasional and casual players at places such as amusement parks where the players are more interested in sheer pleasure or having fun than engaging in serious competition in playing the game. In crowded areas, the conventional horseshoe game can be dangerous to by-standers, and even to players standing or sitting near the pits, in that pitched horseshoes sometimes roll or tumble or are accidentally pitched into the crowd or onto a player. Consequently, a relatively large space for each playing court should be provided in order to assure the safety of the by-standers and the players, particularly when the players are novices and beginners such as those likely to be playing at amusement parks, public sports attractions and the like. It is therefore one of the principal objects of the present invention to provide a horseshoe game apparatus which permits the use of the skills, regulation or modified shoes and rules of the conventional horseshoe game, and in which only one pit is used, with the players all using a single station located at the end of the court opposite the pit, where the second pit is normally located.

Another object of the invention is to provide a horseshoe pitching game apparatus in which a single pit used in the game is prepared mechanically for each pitch, or for each turn of the players, to provide optimum conditions in the pit for receiving the shoe or shoes, and in which the pitched shoes are removed from the pit and returned to the player's station at the opposite end of the court.

A further object of the invention is to provide a horseshoe pitching game apparatus in which the pitched shoe is monitored to determine the position of the shoe with respect to the stake and the score calculated and reported on a screen readily visible to the player at the pitching station, and in which the action of the players in pitching the shoes activates a television camera and computer or other suitable detection and/or measuring device for determining whether the pitch is a foul or not, and reveals the score or placement of the pitch and may convert the results of the pitch into the score.

Still another object of the invention is to provide a horseshoe game apparatus of the aforesaid type, which can be easily installed and used either indoors, with appealing and controlled environment possible, or outdoors, and can be set up in single, multiple, permanent or portable lanes or pitching alleys which will be safe with respect to the players, etc. and spectators or by-standers in that the shoes are always pitched away from the players and others toward a single pit at the opposite end of the court, and which can be used to play the game for either sheer enjoyment by unskilled players or by professional players in serious competition.

Additional objects and advantages of the present invention will become apparent from the following description and accompanying drawings, wherein.

Figure 1:
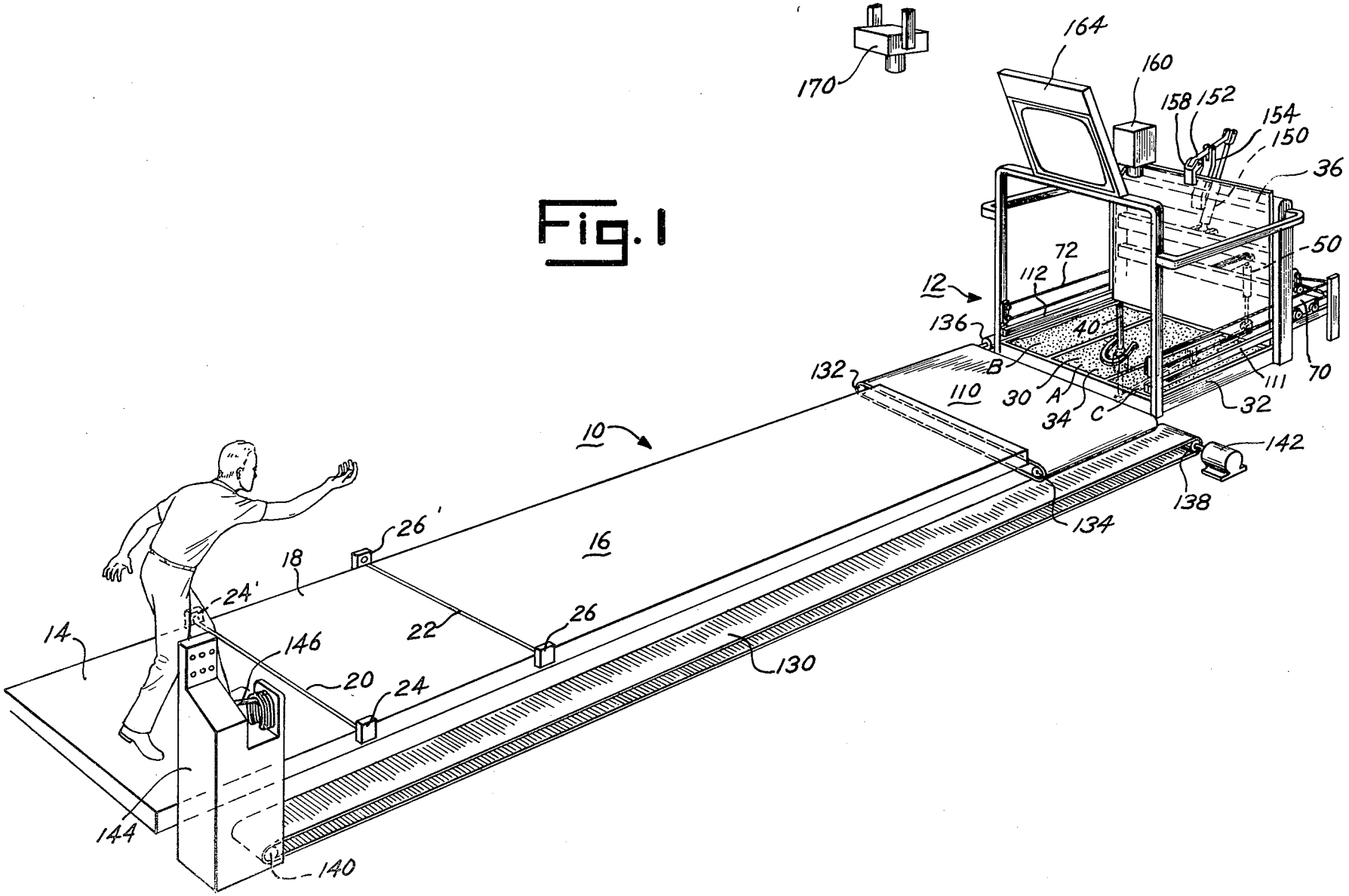
FIG. 1 is a perspective view of the present horseshoe pitching game showing the manner in which it is used by a player.

Referring more specifically to the drawings, and to FIG. 1 in particular, numeral 10 designates generally the present horseshoe pitching game apparatus, numeral 12 a pit assembly, 14 the station from which the players pitch the shoes, and 16 a lane interposed between the station and the pit assembly. The distance between the station and the pit assembly preferably is that required to meet regulations of a standard horseshoe game. The three parts, i.e. station, lane and pit assembly, may be manufactured and shipped separately and assembled in an indoor arena, or installed either temporarily or permanently either indoors or outdoors. One of the main features of the present invention is the adaptation of the horseshoe game to a single pit and a single player station so that the shoes are always pitched in one direction, away from spectators, crowds and the players who are not in the action of pitching.

Station 14 and lane 16 may be of any suitable construction, such as wood, asphalt or concrete, and may be covered with artificial turf or any other suitable material. The station preferably is level, relatively smooth and provided with a non-skid surface so that the players will have a consistent and effective footing for performing the pitching action. In the embodiment illustrated in the drawings, a second station 18 is provided for women and children, station 14 normally being used by the men players. The surface of station 18 is of the same construction and design as the surface of station 14. Foul lines 20 and 22 for stations 14 and 18, respectively, are preferably provided with a photoelectric device or any other suitable electrical or electronic-responsive mechanism to sense and indicate whether the player from either station 14 or 18 has overstepped the respective foul lines. The electronic sensing device is indicated schematically by a pair of boxes 24 and 24' and 26 and 26' for stations 14 and 18.

The pit assembly includes a pit 30 consisting of a frame 32 having opposite sides and front and rear sides and a bottom for retaining suitable material, such as clay 34 or sand combined with other suitable material. The material is normally particulated and relatively loose so that it will absorb the momentum of the pitched shoes and yet can be returned to and maintained in a smooth condition. The pit is shown divided into three sections, namely center A and side sections B and C, the center section being the area in which the shoes are intended to be pitched and the two side sections for receiving shoes landing laterally beyond the scoring area. The horizontal lines which separate the pits between the sections and the sides of the pit, B and C, may be pressure sensitive or responsive in order to detect shoes which are pitched into those areas. The pit assembly has a backboard 36 which is sensitive to contact. Hence the two sides B and C and the backboard will produce a signal for the computer controlling the results of the game so that it will show whether or not the shoes pitched are legal or valid. Retractable stake 40 is disposed in the center of section A of the pit, the retracting mechanism being more fully described hereinafter.

Figure 2:
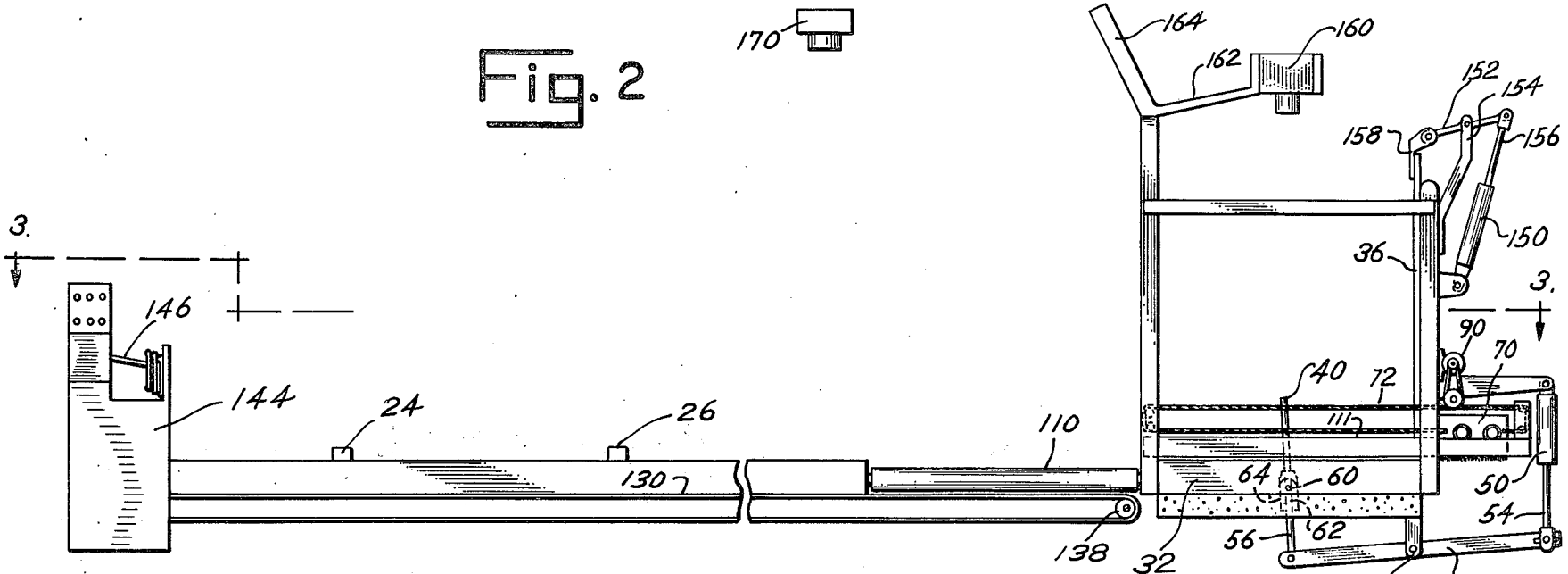
FIG. 2 is a side elevational view of the horseshoe pitching game apparatus shown in FIG. 1.

After either the first or second shoe has been pitched, the pit clearing and reconditioning mechanism is activated, either manually at the station or by the computer. Hydraulic cylinder 50, which is connected to retractable stake 40 by a linkage consisting of a lever 52, shaft 54 and extension 56 of stake 40, is operated to move the lever in a counterclockwise direction, as seen in FIG. 2, on pivot 58, thus moving stake 40 downwardly below the surface of the material in the pit. The stake is supported and guided by a pin 60 in a slot 62 of the stake support structure 64. Thus, when hydraulic cylinder 50 is operated to withdraw shaft 54 upwardly, the stake is moved downwardly. The pit clearing and conditioning device, indicated generally by numeral 70, is then moved over the pit surface by a cable 72 attached to the device 70 at opposite ends thereof and trained on rollers 74 and 76 and 78 and 80 at the forward end of the pit and on rollers 82 and 84 and 86 and 88 at the rear end of the pit. The cable is driven by a gear reduction motor 90 through a belt 92 and a pulley 94.

When the motor is actuated, the clearing and reconditioning device 70 is moved forwardly over the surface of the pit and returned to the original position. A plurality of magnets 96, shown in three separate sets 98, 100 and 102, when energized, lift the steel horseshoe or shoes from the pit surface and carry them forwardly to a belt conveyor 110 where the magnets are de-energized to permit the shoe or shoes to drop onto the conveyor.

Figure 3:
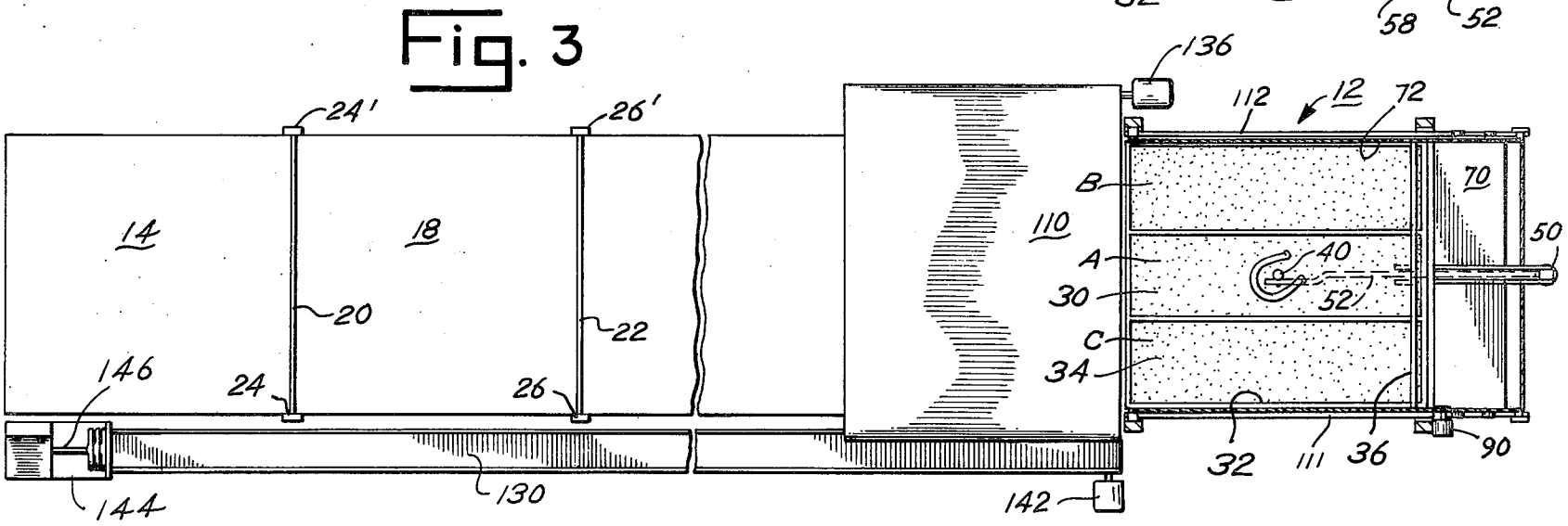
FIG. 3 is a top plan and cross sectional view of the game apparatus shown in FIGS. 1 and 2, the section being taken on line 3—3 of FIG. 2.
Figure 4:
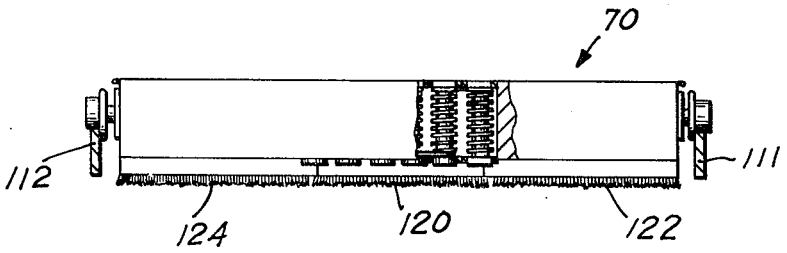
FIG. 4 is an elevational and partial cross sectional view of the mechanism used to remove the pitched shoes from the pit and to prepare the material in the pit for further playing.
Figure 5:
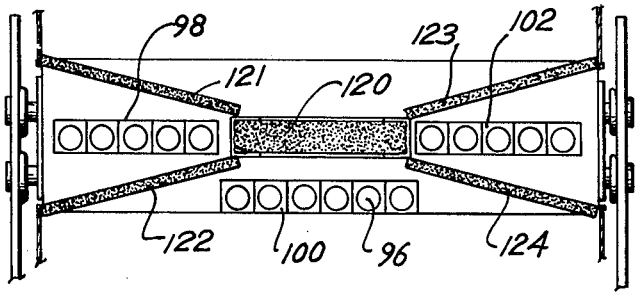
FIG. 5 is a bottom view of the mechanism shown in FIG. 4.
Figure 6:
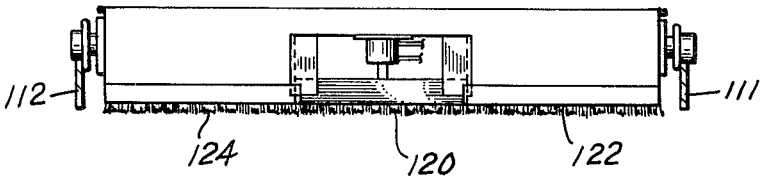
FIG. 6 is an elevational view of the side of the mechanism shown in FIG. 4 opposite that shown in the latter figure.
Figure 7:
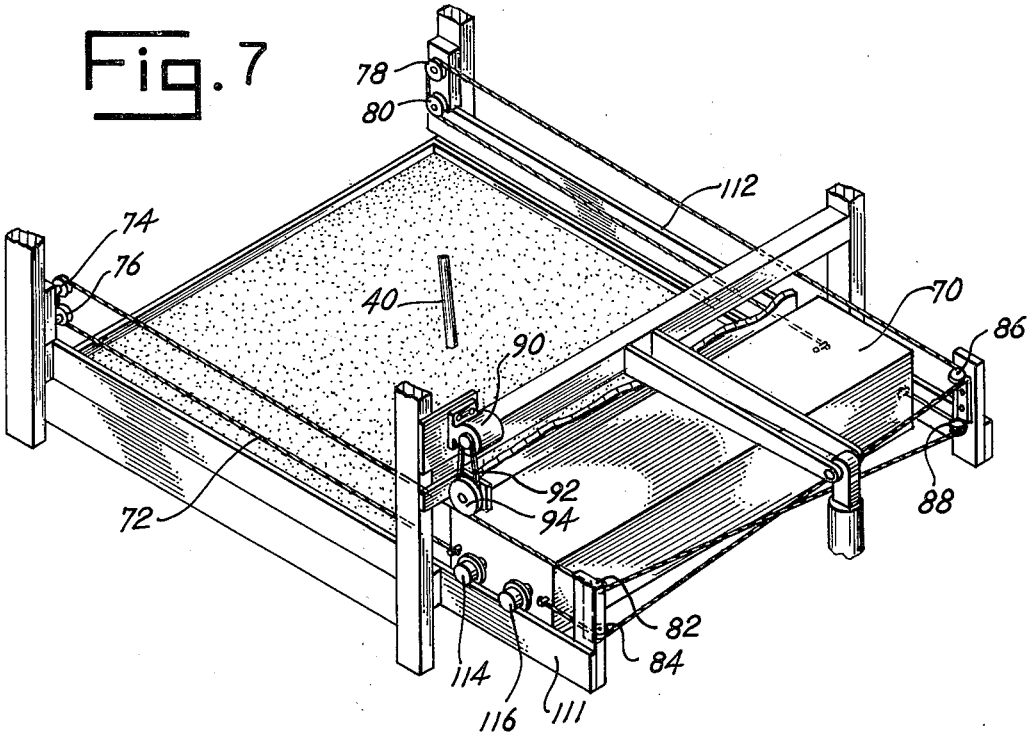
FIG. 7 is an enlarged perspective view of the pit mechanism shown in FIG. 1 and the drive for operating the mechanism for removing the pitched shoes from the pit and preparing the pit for further playing.

The clearing and reconditioning device 70 is supported for movement from its rearward to its forward position and return by tracks 111 and 112 mounted on opposite sides and constituting, in effect, an upward extension of the two side walls of the pit. Rollers 114 and 116 mounted on both ends of device 70 roll on tracks 111 and 112. The tracks extend rearwardly beneath rear wall 36 so that when the device is in its most rearward position, the front portion of the housing of the device is behind the rear wall and is thus protected from the pitched shoes. The device includes in addition to the magnets 96 several sets of brushes 120, 121, 122, 123 and 124 for smoothing the surface of the material in the pit preparatory to the next pitch of the shoe. The movement of the brushes over the surface of the material in the pit, as device 70 is moved forwardly and rearwardly, while stake 40 is in its retracted position, levels and smooths the surface of the material, filling any depressions and leveling off any piles created by the previous pitch or pitches. The belt conveyor 110 moves to the right, i.e. downwardly as viewed in FIG. 3, to carry the shoes to the right hand side of the lane. An elongated belt conveyor 130 receives the shoes discharged by conveyor 110 and returns the shoes to the player's station. The belt of conveyor 110 is mounted on rollers 132 and 134 and is driven by a motor 136, and the belt of conveyor 130 is mounted on rollers 138 and 140 and is driven by a motor 142. A stand 144 is mounted over the station end of conveyor 130 and may contain a compartment in the lower part thereof for receiving the shoes as they reach the end of the conveyor. The shoes thereafter may be picked up and placed on a rack 146 or other suitable and convenient holding device. If desired, a mechanism may be included in stand 144 for automatically lifting the shoes and depositing them on rack 146.

The backboard 36 preferably extends downwardly in front of device 70 so that any shoe contacting the rear of the pit is deflected by the backboard. In order to permit the device 70 to operate to clear and recondition the pit, the backboard is lifted by a hydraulic cylinder 150 through a pivoted lever 152 pivotally supported by a rigid arm 154, the arm being connected to piston rod 156 and to a bracket 158 on the upper edge of the backboard 36. When the cylinder is contracted, the backboard is lifted sufficiently to permit the pit clearing and reconditioning device 70 to pass beneath the board. After the device has returned to its original position at the rear of the pit structure, the backboard descends to its lower position. A television camera 160 mounted above the pit on bracket 162 sends a signal from the pit to the computer, which then determines the validity of the pitch and computes the score resulting from the position of the shoe relative to the stake. The computer then transmits the score to the scoreboard indicated generally by numeral 164, preferably mounted on the front of the pit frame structure. The mechanism is initially actuated by a pitch detector indicated generally by numeral 170 mounted above the lane. This pitch detector may be of an ultrasonic type or some other suitable sensing device responsive to the passage of the shoe pitched from station 14 or 18 to pit 12. The signal received by device 170 actuates the television camera and sets in motion the sequence of operation for determining the validity of the shoe pitched and the score resulting therefrom. Thereafter the sequence of operation for clearing and reconditioning the pit is set in motion by the computer so that the pitch of the first or second shoe, as desired, activates the system to perform the foregoing sequence of operation.

In the operation and use of the foregoing horseshoe game apparatus, the player stands at station 14, for example, and pitches a shoe from the station to the pit. If the player steps over line 20, a foul is immediately registered so that the pitch will not be counted in the score. Assuming that the pitch is valid and lands in section A of the pit, the system is first energized by the shoe passing beneath sensor 170, thereby energizing the television camera, which transmits the signal to the computer, not shown, which, in turn, determines whether or not the pitch is valid, and if so, records the score and flashes it on screen 164. One, two or four shoes may be pitched, as desired, depending upon the sequence programmed into the computer and, after the first shoe, for example, of the player has been pitched, the clearing operation commences with the actuation of cylinders 50 and 150 which lower stake 40 and raise backboard 36, respectively. The motor 90 is then energized to move the pit clearing and reconditioning device 70 forwardly beneath the backboard and over the surface of the pit to first permit the magnets 96 to lift the shoe and then the brush to smooth the surface of the material.

When the device is moved to its forwardmost position, the magnets are de-energized to permit the shoe to drop onto conveyor 110, which moves the shoe to the right side of the lane and drops it onto conveyor 130, which in turn delivers the shoe to console 144. When the shoe reaches console 144 at station 14, it may be dropped into a compartment or box or automatically elevated to a hanger 146. After the shoe or shoes have been dropped on conveyor 110, motor 90 reverses operation to return the device 70 to its initial position at the rear of the pit, and the two hydraulic cylinders 50 and 150 are operated to return the stake to its normal operating playing position and the backboard to its lowered position, respectively. The apparatus is now in condition for the next pitch, and the same sequence of operation of the apparatus is followed from one shoe to the next and from one player to another. If desired, the clearing and reconditioning operation can be performed either after the first, second or fourth shoes are pitched, or after each player has taken his turn.

Figure 8:
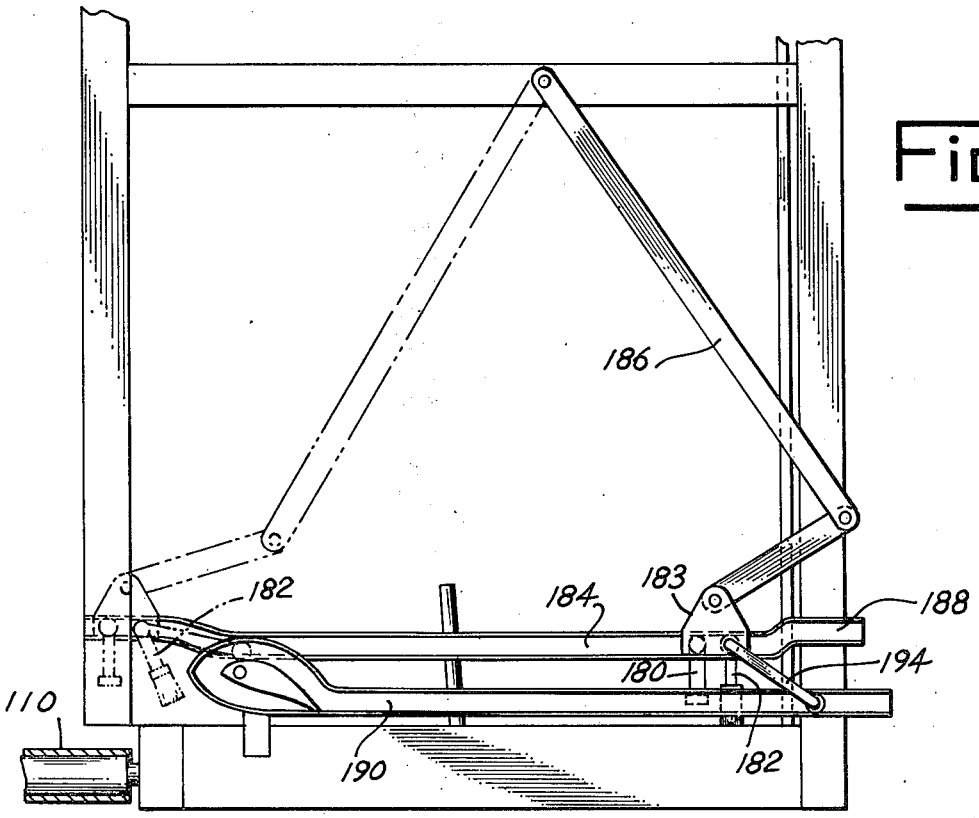
FIG. 8 is a modified form of the mechanism for removing the pitched shoes from the pit and preparing the pit for further playing.

FIG. 8 shows a modified form of a mechanism for clearing and reconditioning the pit. In this embodiment, a series of magnets 180 and brushes 182 on a carrier 183 are moved forwardly on tracks 184 by an operating linkage 186. When the device is in its rearward position, the carrier supports the magnets and brushes on track extension 188. When the linkage is actuated by a motor, not shown, the magnets are carried to a position where they are above conveyor 110, and when de-energized deposit the shoe or shoes on the conveyor. In order to operate the brush in the manner which effectively smooths the surface of the pit, a guide and cam structure, indicated generally by numeral 190, through a lever 194, tilts the brushes 182 on the carrier, and simultaneously therewith, track 184 elevates the brushes to a position above the surface of the pit. The linkage, which is then operated by the motor in a manner similar to the operation of motor 90, returns the carrier with the brushes and magnets to its original starting position. The remaining mechanism and structure, including the stake retractor, backboard elevator, computer and scoring system, are essentially the same with this embodiment as with the one previously described herein. Both in this embodiment and in the previous embodiment described herein, the pit clearing and reconditioning device 70 may be mounted in the pit assembly to move from one lateral side to the other. With this arrangement, conveyor section 110 may be dispensed with.

While only one embodiment and a modification have been described in detail herein, various changes and modifications may be made without departing from the scope of the invention.

We claim:

1. A horseshoe pitching game apparatus comprising a court with a player station at one end, a shoe receiver assembly with a pit and a stake at the other end and a lane between said station and shoe receiver assembly, particulated material in said pit for receiving the pitched shoes, a conveyor means including a conveyor belt disposed in front of said pit, extending between said station and pit assembly for transporting pitched shoes from the pit assembly to the station, a backboard and two sideboards at the edge of said pit for confining the pitched shoes, a means for removing the pitched shoes from the pit and depositing them on said conveyor belt in front of said pit, a means movable in a horizontal plane over said pit for smoothing said material between pitches of the shoes after the shoes have been removed from said pit, and means adjacent said station for receiving the shoes returned by said conveyor means.

2. A horseshoe pitching game apparatus as defined in claim 1 in which said means for removing the pitched shoes from the pit and depositing them on said conveyor includes a plurality of magnets for attracting the shoes when the magnets are energized and for releasing the shoes when the magnets are de-energized.

3. A horseshoe pitching game apparatus as defined in claim 2 in which said pit assembly includes a means for retracting said stake below the surface of the pit.

4. A horseshoe pitching game apparatus as defined in claim 1 in which a mechanism is included for lifting said backboard and another mechanism is included for retracting said stake downwardly below the surface of the pit.

5. A horseshoe pitching game apparatus as defined in claim 1 in which said means for removing said pitched shoes from the pit and depositing them on the conveyor belt includes a plurality of magnets, and said means for smoothing said material in said pit includes a brush means, and a carriage supporting said brush means and being moveable from a position to the rear of said pit to a position to the forward edge of said pit.

6. A horseshoe pitching game apparatus as defined in claim 5 in which said conveyor means includes a second conveyor belt disposed in front of said shoe receiver assembly.

7. A horseshoe pitching game apparatus as defined in claim 5 in which a mechanism is disposed on the assembly for lifting the lower portion of said backboard to permit said carriage to pass thereunder when it performs the shoe removing and material smoothing operations.

8. A horseshoe pitching game apparatus as defined in claim 7 in which said pit assembly includes a means for retracting said stake below the surface of the pit.

9. A horseshoe pitching game apparatus as defined in claim 1 in which a television camera is mounted about said pit and a computer is included for receiving signals from said camera and reporting the results of the pitch to the players.

10. A horseshoe pitching game apparatus as defined in claim 9 in which an electrically operated foul line is disposed at the forward edge of the player station and is connected to said computer to record as illegal any step by the player over the forward edge of the station.

11. A horseshoe pitching game apparatus as defined in claim 9 in which a screen is provided on which the report from the computer is projected.

12. A horseshoe pitching game apparatus as defined in claim 9 in which a means is disposed along said lane for sensing the movement of a horseshoe from the player station to the pit for activating said camera and computer.

13. A horseshoe pitching game apparatus as defined in claim 12 in which said backboard and two sides are electrically sensitive to contact by a shoe for producing a signal indicating invalidity of the pitch.

* * * * *